United States Patent [19]

Caporaso

[11] 4,435,434

[45] Mar. 6, 1984

[54] PACKAGING SYSTEM FOR FULLY BAKED, UNFILLED PASTRY SHELLS

[75] Inventor: John A. Caporaso, Ringwood, N.J.

[73] Assignee: Nabisco Brands, Inc., Parsippany, N.J.

[21] Appl. No.: 523,627

[22] Filed: Aug. 15, 1983

Related U.S. Application Data

[63] Continuation-in-part of Ser. No. 344,290, Feb. 1, 1982, Pat. No. 4,399,157.

[51] Int. Cl.[3] ..... B65D 85/36

[52] U.S. Cl. ..... 426/108; 206/497; 206/499; 206/508; 206/585; 206/45.33; 426/124; 426/128; 426/396

[58] Field of Search ..... 426/128, 108, 396, 124, 426/119, 412; 206/508, 499, 497, 517, 551, 585, 583, 526, 45.33, 45.32

[56] References Cited

U.S. PATENT DOCUMENTS

| | | | |
|---|---|---|---|
| 1,102,191 | 6/1914 | Hammond | 206/585 |
| 1,792,303 | 2/1931 | Hitchins | 426/124 |
| 1,808,136 | 6/1931 | Gray | 206/594 |
| 1,882,524 | 10/1932 | Sherman | 426/124 |
| 2,024,033 | 12/1935 | Epstein | 206/45.32 |
| 2,111,021 | 3/1938 | Bemis | 426/556 |
| 2,146,719 | 2/1939 | Chaplin et al. | 206/45.32 |
| 2,180,465 | 11/1939 | Gelfand | 426/128 |
| 2,476,923 | 7/1949 | Sogas | 426/108 |
| 2,965,501 | 12/1960 | Harriss | 206/508 |
| 3,119,542 | 1/1964 | Pomerantz | 206/594 |
| 3,146,112 | 8/1964 | Weinstein | 426/124 |
| 3,190,758 | 6/1965 | Hauf | 426/391 |
| 3,212,907 | 10/1965 | Caprioli | 426/124 |
| 3,246,744 | 4/1966 | Marnon | 206/585 |
| 3,257,768 | 6/1966 | Harrison et al. | 206/45.33 |
| 3,261,530 | 7/1966 | Cave | 206/551 |
| 3,286,825 | 11/1966 | Laas | 206/594 |
| 3,288,278 | 11/1966 | Rich et al. | 426/128 |
| 3,379,536 | 4/1968 | Foss et al. | 426/119 |
| 3,392,902 | 7/1968 | Donovan | 426/124 |
| 3,406,856 | 10/1968 | Griffith et al. | 426/128 |
| 3,407,079 | 10/1968 | Griffith et al. | 426/397 |
| 3,441,418 | 4/1969 | Nishikiori | 426/556 |
| 3,492,127 | 1/1970 | Ketch et al. | 426/556 |
| 3,493,107 | 2/1970 | Markey | 206/497 |
| 3,637,404 | 1/1972 | MacManus | 426/124 |
| 3,656,967 | 4/1972 | Barton et al. | 426/556 |
| 3,692,535 | 9/1972 | Norsby et al. | 426/556 |
| 3,692,544 | 9/1972 | Dendrinos | 206/45.32 |
| 3,710,931 | 1/1973 | Hollinger | 426/108 |
| 3,745,025 | 7/1973 | Hollinger | 426/128 |
| 3,835,994 | 9/1974 | Davis et al. | 426/128 |
| 3,861,576 | 1/1975 | Tolaas et al. | 426/396 |
| 3,962,469 | 6/1976 | Leavens et al. | 426/108 |
| 4,082,187 | 4/1978 | Carlson | 426/108 |
| 4,265,919 | 5/1981 | Munter et al. | 426/138 |
| 4,323,585 | 4/1982 | Manser | 426/124 |

*Primary Examiner*—Steven L. Weinstein
*Attorney, Agent, or Firm*—R. Kornutik

[57] ABSTRACT

Disclosed is a packaging system capable of protecting the freshness and structural integrity of fully-baked pastry shells during shipping and storage. According to the disclosure, individual baked pastry shells, held in conforming baking pans, are provided with a wrapping of high polymer film; a plurality of the so-wrapped shells are arranged together to form a vertical stack; and one or more of such stacks is then surrounded and enclosed with a corrugated shipping container. The shipping container is provided with a separately-closeable liner of high polymer material and/or the individual stacks are surrounded by a high polymer bag material.

8 Claims, 6 Drawing Figures

PACKAGING SYSTEM FOR FULLY BAKED, UNFILLED PASTRY SHELLS

This application is a continuation-in-part of my copending U.S. patent application Ser. No. 344,290, filed Feb. 1, 1982, entitled "Packaging System", now U.S. Pat. No. 4,399,157.

BACKGROUND OF THE INVENTION

The present invention relates to packaging, and particularly to a packaging system capable of protecting fully-baked pastry shells from the rigors normally associated with commercial shipping and distribution.

The availability of pre-prepared, fully-baked pastry shells, such as pie shells, for consumer purchase or for use by restaurants or food services, provides increased convenience in the preparation of desserts and main meal portions employing them. To be effective substitutes for freshly-prepared pastry shells, these pre-prepared products must exhibit the desirable attributes of their fresh-baked counterparts.

Notable among these attributes is the characteristic flaky, delicate texture of pastry shells. Attainment of this property in pastry shells intended to be purchased or used some time after manufacture is a difficult task in itself, since steps taken to confer this storage-stable texture cannot be at the expense of attainment of other necessary properties such as flavor. More importantly, however, all efforts to prepare shelf-stable pastry shells exhibiting fresh-baked texture and flavor will simply be for naught unless suitable means exist for shipping the extremely fragile pastry shells from the point of manufacture to the point of intended use or purchase. Formula and process variations designed to make the pastry shell itself more capable of withstanding the rigors of commercial handling and shipping generally are counterproductive since these variations are at the expense of attainment of the desired, delicate texture.

The provision of commercial shipping containers for fragile pastry shells must be achievable at reasonable costs and the containers must be sufficiently uncomplicated so as not to make unpackaging of the shells by employees at the point of use or purchase and/or by the ultimate consumer unreasonably difficult.

According to one prior art attempt to package pie crusts, Griffith et al. in U.S. Pat. No. 3,407,079 packages graham cracker crusts, uncooked pie dough, or other prepared or partially prepared pastry products by packaging the individual crusts, maintained within metal baking pans, one on top of another, and holding a stack of crusts within a packaging receptacle which prevents movement of the stack within the receptacle. Compression of the individual crusts within the stack requires that the pans and the crusts retain sufficient resilience or spring so that they exert a counter thrust against the bottom and cover of the receptacle to assure that looseness will not develop after the package is completed. Packaging fully-baked pie or other pastry crusts in the nested relationship under compression as disclosed by Griffith et al. would lead to unacceptably high levels of breakage caused by the packaging alone.

Another means for packaging pie crusts is disclosed in U.S. Pat. No. 3,379,536 to Foss, et al., wherein individual unbaked crusts, maintained in baking pans, are stacked or nested. The uppermost pie pan is fitted with a rigid retainer or cover member conforming to the shape of the pie pan and crust and having a flanged skirt which overlies the peripheral edges of the flanges of all the pie pans in the stack. The assembled stack is then provided with a plastic overwrap loosely enclosing the cover member. The packaging system of Foss, et al. is not suitable, however, for packaging fully-baked pastry shells.

According to another prior art attempt at providing the convenience of formed pastry products at home, Munter et al. in U.S. Pat. No. 4,265,919 describe a frozen, pre-prepared shell packaged along with a food material containing a normally-liquid component. The shell is positioned over a centrally-depressed receptacle containing normally-liquid material by means of an outwardly and downwardly extending rim around the receptacle. As distributed, the pastry shell and the normally liquid material are frozen. To prepare the products for consumption, the combined package is heated to liquify the ingredients of the filling material, and the package is then inverted to permit the liquid ingredients to fill the pastry shell for final baking. While products of this type may offer a degree of convenience, they do not solve the basic problem of providing a simple and effective packaging system for protecting fully-baked pie crusts, not packaged with a filling material, against the repeated impacts and shocks under varying ambient conditions which are typical of commercial handling and distribution.

In my earlier application Ser. No. 344,290, now scheduled for issuance as U.S. Pat. No. 4,399,157 on Aug. 16, 1983, I describe a packaging system for protecting the freshness and structural integrity of fully-baked pastry shells during shipping and storage. The packaging system consists of placing individual fully-baked pastry shells, held in conforming baking pans, in individual paperboard cartons. At least one stack of cartons is then enclosed by a bag comprised of high polymer film, and shock absorbing material then positioned to totally surround the bagged carton stack. Finally, a corrugated shipping container is employed to enclose the shock absorbing material, the bag and the cartons.

The packaging system of my application Ser. No. 344,290 is an effective means for providing fully-baked pastry shells in individual, point of sale packages, which packages do not themselves necessarily have to be constructed so as to withstand the rigors of commercial handling and shipping. However, efforts have continued to still further reduce the cost of the overall packaging system without loss of the primary function of protecting the freshness and structural integrity of the fragile, fully-baked pastry shells in a manner not inconsistent with point-of-sale or point-of-use distribution of individual pastry shells.

SUMMARY OF THE INVENTION

In accordance with the present invention, a packaging system for preserving the freshness and structural integrity of fully-baked pastry shells comprises individual fully-baked pastry shells, held in conforming baking pans, provided with a high polymer film wrapping; a plurality of the so-wrapped shells arranged together to form a vertical stack; and one or more of such stacks then surrounded and enclosed with a corrugated shipping container having a separately-closeable high polymer liner. Alternatively, the individual stacks of pastry shells can be enclosed in a high polymer bag material.

An important feature of the present invention is the provision of a wrapping of high polymer film on the combined pastry shell and baking pan. The wrapping is arranged to substantially conform to the outer surface dimensions of the baking pan and to stretch across the upper open portion of the pastry shell so as to define an enclosed air space substantially equal to the filling volume of the pastry shell. The high polymer film, in its wrapped condition, is of sufficient strength and resiliency so as not to be broken when wrapped shells are stacked together and subjected to the conditions encountered in commercial shipping and handling. In addition, the resiliency/strength of the wrapped film is such that the arrangement of wrapped shells in a stack and the conditions encountered in shipping and handling will not result in the portion of the film stretched across the upper open surface of any of the pastry shells being deformed or depressed to the point such that any of the individual shell and pan combinations in the stack nest together in a manner whereby the bottom surface of a baking pan actually rests against the inner surface of a film-wrapped pastry shell below it.

According to particular embodiments of the present invention, the stack of wrapped pastry shells is arranged within the corrugated shipping container such that the stack is maintained in substantially fixed position in the container with respect to both vertical and horizontal movement. When one stack is employed, maintenance of the desired fixed position is achieved by appropriate dimensioning of the shipping container such that the container surfaces (e.g., top, bottom and side panels of a square or rectangular box) per se restrict movement of the stacked shells. Where more than one stack of pastry shells is arranged within the container, suitable dividers are employed to restrict movement of the stacks in the container in conjunction with surfaces of the container itself while avoiding undesired contact of stacks with each other.

By the term "substantially fixed position" within the shipping container, however, is meant to describe the positioning of the stacks such that they are not completely constrained against all movement by the container or dividers therein. Where the stacks are completely constrained, shocks resulting from movement or rough handling which the shipping container encounters in commercial environments are directly transmitted from the walls of the container to the pastry shells and may put the stacked shells under sufficient stress to cause breakage or cracks in the shells. In addition, a requirement for complete constraint renders the stacks difficult to remove from the shipping container at the point of sale.

In accordance with further embodiments of the invention, the high polymer film liner of the corrugated shipping container can be replaced by, or employed in conjunction with, high polymer bag material encasing each individual stack of wrapped pastry shells within the shipping container.

BRIEF DESCRIPTION OF THE DRAWINGS

The invention will be better understood and its advantages will become more apparent when the following detailed description is read in light of the attached drawings, wherein.

DETAILED DESCRIPTION

Figure 1:
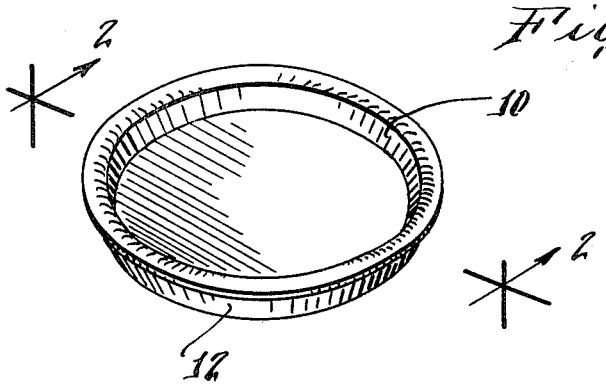
FIG. 1 is an exploded view, in perspective, of a pastry shell held in a conforming baking pan.

FIG. 1 shows an individual pastry shell 10, maintained within a pan 12.

The pan 12 can be of any suitable construction, but preferably is constructed out of aluminum foil which is crimped to the desired size and shape. According to one particularly preferred embodiment, the pan will be constructed from 0.0045 inch thick aluminum foil, having a top outside dimension of 9⅝ inch, a top inside dimension of 8 23/32 inch, a bottom of 7 inches in diameter, and vertical depth of 1⅛ inches. The particular dimensions are not critical to the invention. As an alternative to metal foils for constructing the pan 12, certain ovenable plastic materials, molded pulp or paperboard also can be employed.

The pastry shell 10 will be unfilled according to the invention, and will therefore be extremely fragile. To reduce the degree of fragility of the crust, it should be free from any substantial discontinuities which would decrease its structural strength. Preferably, the crust 10 should have no cracks or docking holes. In other words, the pastry shell 10 will exhibit a substantially continuous surface, free of any significant weaknesses which would increase the chances of breakage. Typically, the pastry shell 10 will have a moisture content of less than about 4.0%, and preferably from about 1.5 to about 3.5%, and be fully-baked in the sense both of reduced moisture content and proper development of the shell ingredients. To achieve an added degree of flexibility while still maintaining the low moisture content, up to about 5% of glycerol can be employed within the shell. Preferably, levels of glycerol of from about 2 to about 3% based upon the weight of the shell are employed. It has been found that the glycerol, in addition to improving the physical strength of the product, also maintains the flaky texture of the pastry shell over extended periods of storage.

According to the present invention, each individual pastry shell, in its conforming baking pan, is provided with a wrapping of high polymer film.

The wrapping of high polymer film is such as to substantially conform to the outer surface dimensions of the baking pan and to stretch across the upper open portion of the pastry shell so as to provide an air space substantially equal to the filling volume of the shell, i.e., in the sense of a cover over the open area of the pastry shell. In the wrapped condition, the high polymer film must possess sufficient strength and resiliency so as to resist breakage when the wrapped pastry shells are stacked and when the stacked, packaged shells are subjected to the rigors of commercial shipping and handling. At the same time, the film is such that the portion which extends over the open area of the pastry shell is not deformable to a degree sufficient to cause any of the wrapped shells to nest upon another wrapped shell in the stack.

The high polymer film wrapping is substantially moisture impervious so as to protect the taste and texture of the pastry shell. In addition, the high polymer film stretched across the open surface of the pastry shell serves as a cushion to prevent breakage of the shells in stacked arrangement and under the conditions encountered in shipping. Thus, while pastry shells are basically uniformly fragile, their strongest points typically are found along the side walls of the shells. Application of a downward force on the stretched portion of the film over the open surface of the shell results in both vertical and horizontal force components such that the net force generally is in a plane substantially parallel to the plane of the side walls of the shell, thereby reducing possibilities of breakage of the shell.

Suitable high polymer films are those which, when wrapped over the shell and baking pan according to the invention, exhibit the requisite moisture impermeability, strength and resilience.

Preferred high polymer film materials are those which possess the capability of having their dimensions reduced, in contact with the baking pan/pastry shell, through inherent action of the film or through application, for example, of heat. Exemplary film materials are heat-shrinkable films and stretch films. Thus, while it is possible to wrap the pastry shell and pan ab initio with a film closely conforming to the outer surface dimensions of the baking pan and stretched across the open surface of the shell, such an operation does not lend itself particularly well to commercial high-speed packaging operations. On the other hand, however, stretchable elastic films and heat-shrinkable films are ideally suited for commercial packaging in accordance with the present invention since they can initially be applied to the pan and shell in a loose-conforming manner and then relaxed or heat-shrinked to provide the required wrapping. In addition, such films tend to be tougher and more moisture impervious than films which must be directly applied in a close conforming manner.

Preferred according to the present invention are heat-shrinkable films, and a number of high polymer films are known to the art which are suitable for this purpose. Particularly good results have been achieved using a biaxially oriented crystalline polypropylene film having an initial thickness of about 0.5 mil, sold by E. I. du Pont de Nemours & Co. under the trade name Clysar. For aesthetic purposes, the film, whether it be stretchable, heat-shrinkable or otherwise, should, in its final form, be transparent and its thickness should be less than about 0.5 mil. In addition, the film, if heat-shrinkable, should not require, for shrinking, temperatures so high as to be impractical to achieve in continuous commercial wrapping and packing equipment, nor so high as to subject the pastry shell and baking pan to conditions at which they might adversely be affected.

Figure 2:
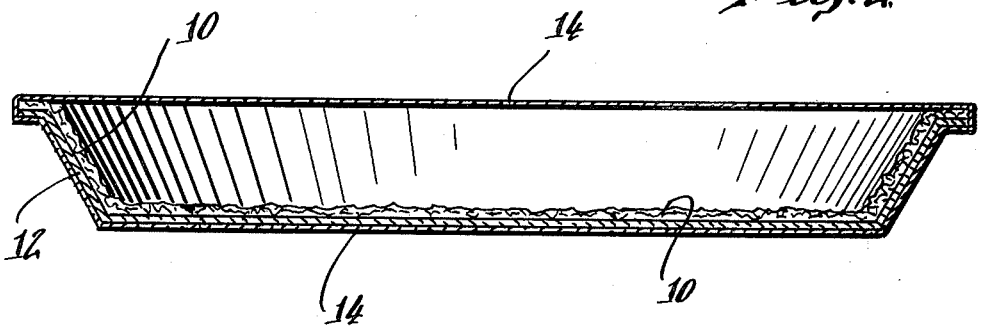
FIG. 2 is an exploded sectional view of a film-wrapped pastry shell in a conforming baking pan.

FIG. 2 shows a sectional view of a wrapped pastry shell and baking pan wherein the film 14 is shown, as conforming to the outer surface dimensions of baking pan 12, and stretched across the upper, open surface of pastry shell 10.

Figure 3:
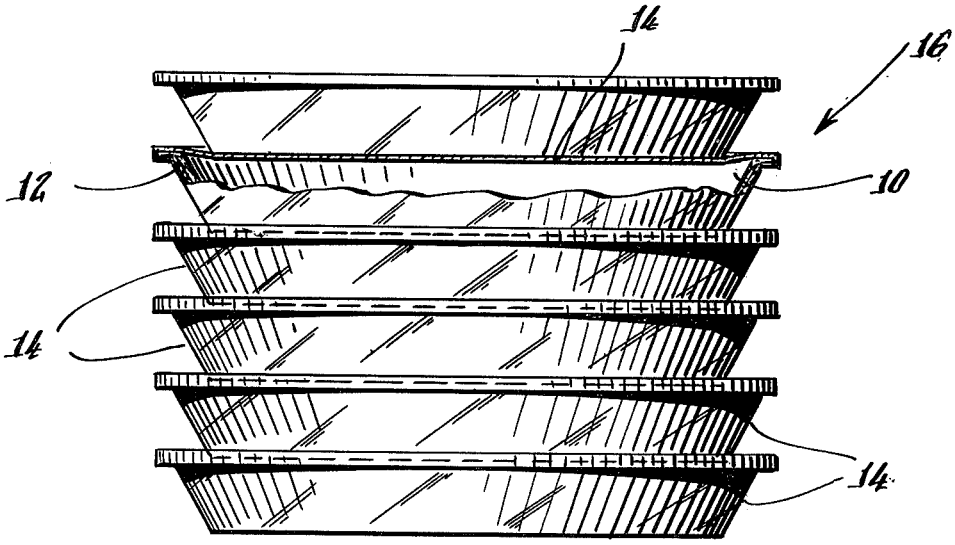
FIG. 3 is a perspective view showing a stack of individual pastry shells, each held in a conforming baking pan and each wrapped with a high polymer film.

In FIG. 3 there is shown a stacked arrangement 16 of six individually wrapped pastry shells and conforming baking pans. At this point it is possible to provide each of the stacks with its own closeable bag of flexible high polymer material, of desired, as either an alternative to utilizing a high polymer material liner in the shipping container or in addition to use of a such a liner. The polymer material, whether employed as a bag for individual stacks of pastry shells and/or as a liner for the shipping container, can be, for example, a polyolefin, preferably transparent, and substantially moisture impervious, such as high density polyethylene. The bag or liner, in one particular embodiment, has a thickness of about two mils. When used as a bag for a stack of pastry shells, the bag preferably will be heat sealable and will be heat-sealed before packing the stack into the shipping container. When employed as a liner, the material need not necessarily be heat sealed (although this is preferred) and can simply be closed over upon itself or tied or bound in some appropriate manner before sealing the shipping container. In either form of use, the bag or liner provides added protection of the freshness of the product and contributes to some degree to protection of the structural integrity of the pastry shells during shipping and handling.

Figure 4:
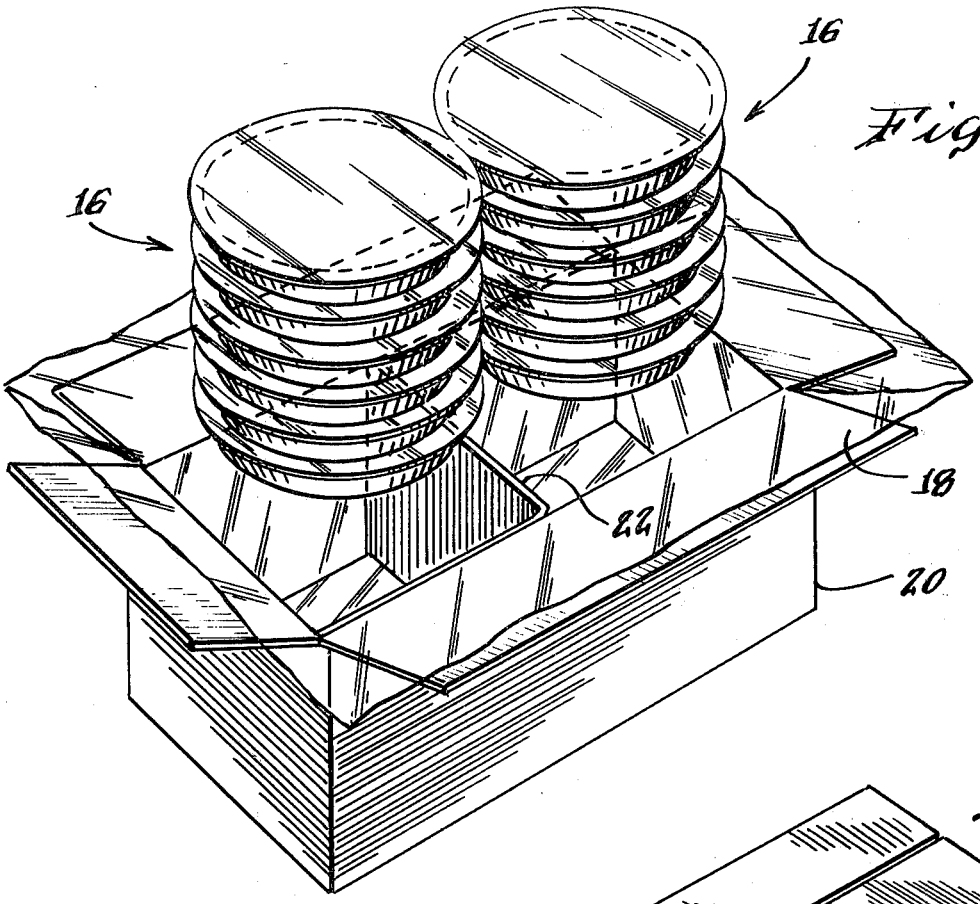
FIG. 4 is an exploded view, in perspective, of the insertion of two stacks of pastry shells into a shipping container.
Figure 5:
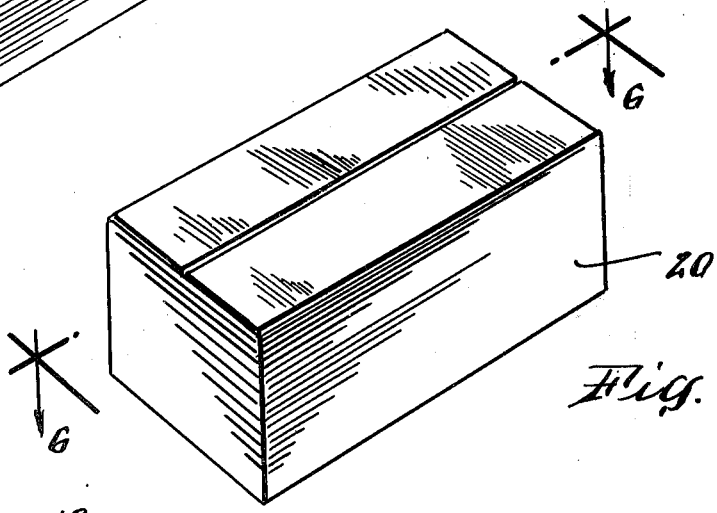
FIG. 5 shows the outward appearance, in perspective, of the completed packaging system to indicate the plane along which the sectional view of FIG. 6 is taken.

In the perspective view of FIG. 4, two nested stacks 16 of pastry shells are shown being inserted into shipping container 20 in which a high polymer liner 18 is pre-inserted. In order to separate the two pastry shell stacks from each other, the shipping container is fitted with a divider member 22, generally arranged in the container prior to insertion of the stacks. For the packing of two stacks of pastry shells, a z-shaped divider such as shown in FIG. 4 is preferred. The divider member 22 (or members, when multiple stacks of pastry shells are packed) preferably is of unitary construction and made of rigid material, typically of the same type as employed for the corrugated shipping container.

The liner 18 should be dimensioned as to have an opening perimeter sufficiently larger than the perimeter of the container 20. In this way, the liner 18 can be folded over the closing flaps of container 20 to keep them from interfering with the insertion of pastry shell stacks 16 into the container.

Figure 6:
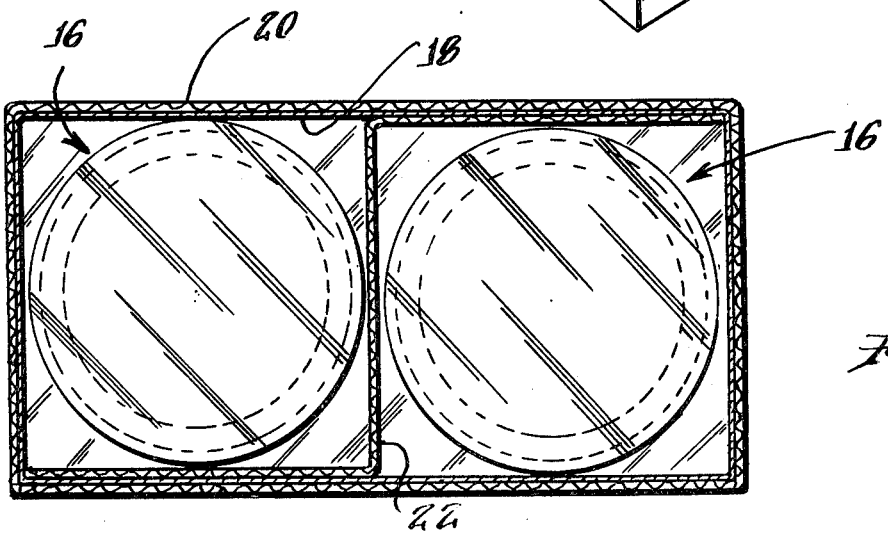
FIG. 6 shows a top sectional view of the packaging system taken along plane 6—6 of FIG. 5.

The positioning of the stacks 16 within the shipping container 20 is shown in the sectional top view of FIG. 6. Each stack 16 is arranged to have the bottom wrapped pan and pastry shell in the stack resting on the bottom surface of the container (not shown), with the stack extending vertically upward therefrom. In the closed position, the top of the shipping container is at a height, relative to the vertical stack 16, so as to maintain the stack in a substantially fixed position, although not completely constrained, with respect to vertical movement.

With respect to lateral movement, as shown in FIG. 6, the individual stacks are positioned so as to be maintained in a substantially fixed position by the sides of the shipping container 20 and the divider element 22. Since complete constraint is not desired, however, the stacks 16 are not in immobilized contact with all these portions of the shipping container but may, as packed, be in contact with some of these elements. The degree of constraint should be such that the stack is not free to engage in extended vertical or lateral movement within the container, but is sufficiently free to yield in either the lateral or vertical direction when force is applied to the outside of the container to a degree sufficient so as not to directly accept the full effect of the applied force.

The corrugated shipping container 16 is preferably constructed of what is known in the art as a 200-pound C-fluted kraft corrugated board. Essentially, this material comprises two outer kraft paper liners separated by an internal layer of continuously fluted kraft paper.

An advantage of the packaging system of the invention, as compared to that designed in my earlier application Ser. No. 344,290, is that a separate shock absorbing material in the container is not required. However, although not required for achievement of the objects of the present invention, the shipping container obviously also can be provided with such shock absorbing material, intermediate the container and the liner, on one or more of its walls, if desired.

Any type of shock absorbing material which is available in sheet form and is capable of providing an adequate degree of protection can be employed. However, the preferred form of shock absorbing material comprises a cellulose wadding which is essentially a kraft paper having a three dimensionally formed undulating configuration is employed in a plurality of layers, typically about 4 to 6. One particular type of cellulose wadding which has been found to be effective is available under the trademark Jiffy Kushion Kraft 051 from Jiffy Packaging Corp. This particular material has five layers held together as a single sheet by mechanical interlock. This material provides good shock absorbing capability and resilience.

In arranging the packaging system of the present invention, the corrugated shipping container, with or without shock absorbing material, will generally be fitted with the liner or bag which is sized to extend above the vertical height of the shipping container such that it can be folded back along the top cover element of the container for receipt of the stacked pastry shells and then folded over and separately closed prior to closure of the container. Where divider elements are employed, these generally are fitted within the lined container before receipt of the stacked pastry shells. As noted earlier, the liner can be replaced by individual bags surrounding each of the stacks of pastry shells or can be used in conjunction with such bags.

The packaging system of the present invention, when constructed as described and shown herein, provides extremely good protection for fully-baked, shelf-stable pastry crusts from the abuse occurring during normal shipping and handling. The pie or other pastry shells reach their point of distribution to the consumer with a substantial degree of protection provided by the polymer film wrapping which maintains the pastry shells within the baking pans and cushions the shells from each when in the stacked arrangement. The stack of shells is easily removable from the shipping container and the individually wrapped shells are easily removable from the stacked array.

The above description is for the purpose of teaching the person skilled in the art how to practice the present invention. This description is not intended to teach each and every obvious modification and variation thereof which will become apparent upon reading. It is intended, however, that each such modification and variation will be included within the scope of the invention which is defined by the following claims.

What is claimed is:

1. A packaging system for protecting the freshness and structural integrity of a plurality of fully-baked unfilled pastry shells during shipping and storage, the system comprising:

at least one vertical stack of said fully-baked unfilled pastry shells, each individual shell being held in a conforming baking pan which is of frusto-conical construction having a supporting base member and an upper open surface, each individual shell and pan wrapped with a continuous, substantially moisture-impermeable high polymer film substantially conforming to the outer surface dimensions of said baking pan and stretched across the upper, open surface of the pastry shell so as to provide an enclosed air space substantially equal to the filling volume of the pastry shell;

said stack being arranged such that the wrapped base member of individual baking pans in the stack rests entirely upon said high polymer film stretched across the upper open surface of a shell and pan therebelow;

said high polymer film possessing sufficient strength and resiliency so as to resist breakage when the wrapped shells are stacked in said vertical stacked arrangement and such that the arrangement of wrapped shells in said vertical stack and conditions encountered in handling and shipping will not result in the portion of the film stretched across the upper open surface of any of the pastry shells being deformed or depressed to the point such that any of the individual shell and pan combinations in the vertical stack nest together in a manner whereby the wrapped base member of a baking pan actually rests against the inner surface of a film-wrapped pastry shell below it;

a high polymer film bag surrounding the stack of pastry shells; and a corrugated shipping container enclosing the high polymer film and the stack of pastry shells.

2. The packaging system according to claim 1 wherein said high polymer film bag comprises a separately-closeable liner for the corrugated shipping container which surrounds all said vertical stacks of pastry shells within the container.

3. The packaging system according to claim 1 wherein said high polymer film bag comprises a separately-closeable bag surrounding each of said individual vertical stack of pastry shells within the container.

4. The packaging system according to claim 1 wherein at least two said vertical stacks of pastry shells are provided in the shipping container and wherein a divider element is present to separate the stacks from each other in the shipping container.

5. The packaging system of claim 1 wherein said vertical stack of pastry shells is arranged within the shipping container in a manner such that the stack is maintained in substantially fixed, but not completely constrained, position within the container.

6. The packaging system according to claim 1 wherein said high polymer film with which said pastry shell and baking pan is wrapped is a heat-shrunk film.

7. The packaging system according to claim 6 wherein said heat-shrunk film is a crystalline polypropylene, transparent film.

8. A stacked arrangement of a plurality of individual pastry shell and conforming pan structures, comprising a vertical stack of fully-baked unfilled pastry shells, each pastry shell being held in a conforming baking pan which is of frusto-conical construction having a supporting base member and an upper, open surface, each individual shell and pan being wrapped with a continuous, substantially moisture-impermeable, heat-shrunk high polymer film substantially conforming to the outer surface dimensions of said baking pan and stretched tightly across the upper open surface of said pastry shell so as to provide an enclosed air space substantially equal to the filling volume of the pastry shell, said stack being arranged such that the wrapped base member of individual baking pans in the stack rests entirely upon said high polymer film stretched across the upper open surface of a shell and pan therebelow;

said high polymer film possessing sufficient strength and resiliency so as to resist breakage when the wrapped shells are stacked in said vertical stacked arrangement and such that the arrangement of wrapped shells in said vertical stack and conditions encountered in handling and shipping will not result in the portion of the film stretched across the upper open surface of any of the pastry shells being deformed or depressed to the point such that any of the individual shell and pan combinations in the vertical stack nest together in a manner whereby the wrapped base member of a baking pan actually rests against the inner surface of a film-wrapped pastry shell below it.

* * * * *